US005430354A

United States Patent [19]

Garbowicz et al.

[11] Patent Number: 5,430,354

[45] Date of Patent: Jul. 4, 1995

[54] HID LAMP AND AUXILIARY LAMP BALLAST USING A SINGLE MULTIPLE FUNCTION SWITCH

[75] Inventors: Glenn D. Garbowicz, Rosemont; Edmond Daniel, Skokie; Joseph S. Droho, Elmwood, all of Ill.

[73] Assignee: North American Philips Corporation, New York, N.Y.

[21] Appl. No.: 980,831

[22] Filed: Nov. 24, 1992

Related U.S. Application Data

[63] Continuation-in-part of Ser. No. 856,771, Mar. 24, 1992, Pat. No. 5,256,946.

[51] Int. Cl.[6] ..... H05B 39/10

[52] U.S. Cl. ..... 315/88; 315/91; 315/90; 315/92; 315/93; 315/159

[58] Field of Search ..... 315/88, 91, 90, 92, 315/93, 159

[56] References Cited

U.S. PATENT DOCUMENTS

| | | | |
|---|---|---|---|
| 3,562,580 | 2/1971 | Blomgren | 315/88 |
| 3,599,036 | 8/1971 | Haymaker | 315/93 |
| 3,694,692 | 9/1972 | Pressman | 315/154 |
| 3,976,910 | 8/1976 | Owens et al. | 315/92 |
| 4,005,331 | 1/1977 | Horowitz | 315/92 |
| 4,961,028 | 10/1990 | Tanaka | 315/91 |
| 4,996,463 | 2/1991 | Horowitz | 315/250 |
| 5,008,599 | 4/1991 | Counts | 315/247 |
| 5,072,156 | 12/1991 | Droho | 315/232 |
| 5,256,946 | 10/1993 | Garbowicz et al. | 315/88 |

FOREIGN PATENT DOCUMENTS 2425720 12/1975 Germany .

*Primary Examiner*—Robert J. Pascal
*Assistant Examiner*—R. A. Ratliff
*Attorney, Agent, or Firm*—Edward Blocker; Bernard Franzblau

[57] ABSTRACT

A ballast for lighting an auxiliary source of illumination whenever a primary source of illumination fails to ignite. The auxiliary source of illumination is effectively turned OFF by placing a short circuit thereacross whenever the primary source of illumination is lit. The short circuit is removed whenever the primary source of illumination fails to reach a predetermined level of illumination thereby permitting current to flow through and light the auxiliary source of light. The ballast also includes a power factor correction device for increasing the ballast power factor when the primary source of light reaches a predetermined level of illumination.

28 Claims, 3 Drawing Sheets

HID LAMP AND AUXILIARY LAMP BALLAST USING A SINGLE MULTIPLE FUNCTION SWITCH

CROSS-REFERENCE TO RELATED APPLICATION

This application is a continuation-in-part of U.S. patent application Ser. No. 07/856,771, filed Mar. 24, 1992, now U.S. Pat. No. 5,256,946 (Oct. 26, 1993).

BACKGROUND OF THE INVENTION

This invention relates generally to a high intensity discharge (HID) lamp ballast and, more particularly to an improved ballasting scheme in which an auxiliary lamp is lit prior to ignition or reignition of an HID lamp or whenever an HID lamp otherwise fails to light.

Gaseous discharge lamps such as high pressure mercury, high pressure sodium, metal halide, high pressure metal vapor and low pressure sodium types are often difficult to ignite and are especially difficult to reignite immediately turn-off. Typically, up to about 15 minutes may be required in order for the lamp to sufficiently cool prior to attempting reignition. The absence of light for any period of time, whether during the initial period for ignition or reignition or due to lamp failure is, of course, undesirable.

Conventional ballasts can also include power factor correction schemes employing capacitive correction. Such schemes draw current from the utility line regardless of whether the HID lamp is lit or not lit. The current drawn by the ballast prior to the lamp lighting can be quite high relative to the current drawn by the ballast once the lamp is lit. The relatively high current level drawn by the ballast prior to the lamp being lit unnecessarily limits the number of power factor corrected ballasts which can be connected to a branch utility power line (i.e. protected by a circuit breaker).

Accordingly, it is desirable to provide an improved HID ballast for lighting an auxiliary light source whenever the HID lamp fails to ignite, reignite or otherwise fails to light. The HID ballast should also include a power factor correction scheme which increases the number of ballasts which can be connected to the branch utility power line.

SUMMARY OF THE INVENTION

Generally speaking, in accordance with a first aspect of the invention, a ballast for lighting at least a first light and a second light includes a current control device responsive to the flow of current therethrough for controlling the flow of current supplied to the first lamp, a switching control device for producing a switching signal representing the flow of current through the current control device and a switching device responsive to the switching signal for substantially short circuiting the second lamp. Preferably, current is supplied to the second lamp in the absence of the switching signal whereby the second lamp is lit.

Generally, the first lamp, which serves as a primary source of light, is of the HID type whereas, the second lamp, which serves as an emergency/auxiliary lamp, is of the incandescent type. The invention therefore provides for illumination of an auxiliary light source (i.e. the second lamp) whenever the switching signal produced by the switching control device indicates that the flow of current through the current control device is insufficient to light the primary light source (i.e. the first lamp). Whenever the switching signal indicates the flow of current through the current control device is sufficient to light the primary light source, the switching device will substantially short circuit the auxiliary light source. The auxiliary light source therefore will not be lit whenever the primary light source is turned ON.

Preferably, the switching device is a triac. The switching control device can include an opto-coupler for supplying the switching signal to the switching device. Alternatively, the control means can include a resistor coupled to the switching device and to a junction between the current control device and the first lamp.

In accordance with a feature of the invention, a power factor correction device is operable for improving the ballast power factor during the time that the second lamp is short circuited. Preferably, the power factor correction device includes a capacitor.

In accordance with a second aspect of the invention, a method for lighting at least a first lamp and a second lamp includes the steps of drawing power from a power source in supplying current to a ballast, ballasting the first lamp in response to the flow of current through the ballast and producing a control signal representing the flow of current through the ballast. The method further includes effectively short circuiting the second lamp in response to the control signal. In accordance with this second aspect of the invention, the power factor of power drawn from the power source can be increased during the time that the second lamp is short circuited.

Accordingly, it is an object of the invention to provide an improved ballast scheme for an HID lamp and auxiliary lamp in which the auxiliary lamp is lit whenever the HID lamp fails to ignite, reignites or otherwise fails to light.

It is another object of the invention to provide an improved ballast scheme for an HID lamp and auxiliary lamp in which the power factor of power drawn from the power source in lighting the HID lamp is increased only when the auxiliary lamp is not lit.

Still other objects and advantages of the invention will, in part, be obvious, and will, in part, be apparent from the specification.

The invention accordingly comprises several steps and the relation of one or more of such steps with respect to each of the others, and the device embodying features of construction, combination of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
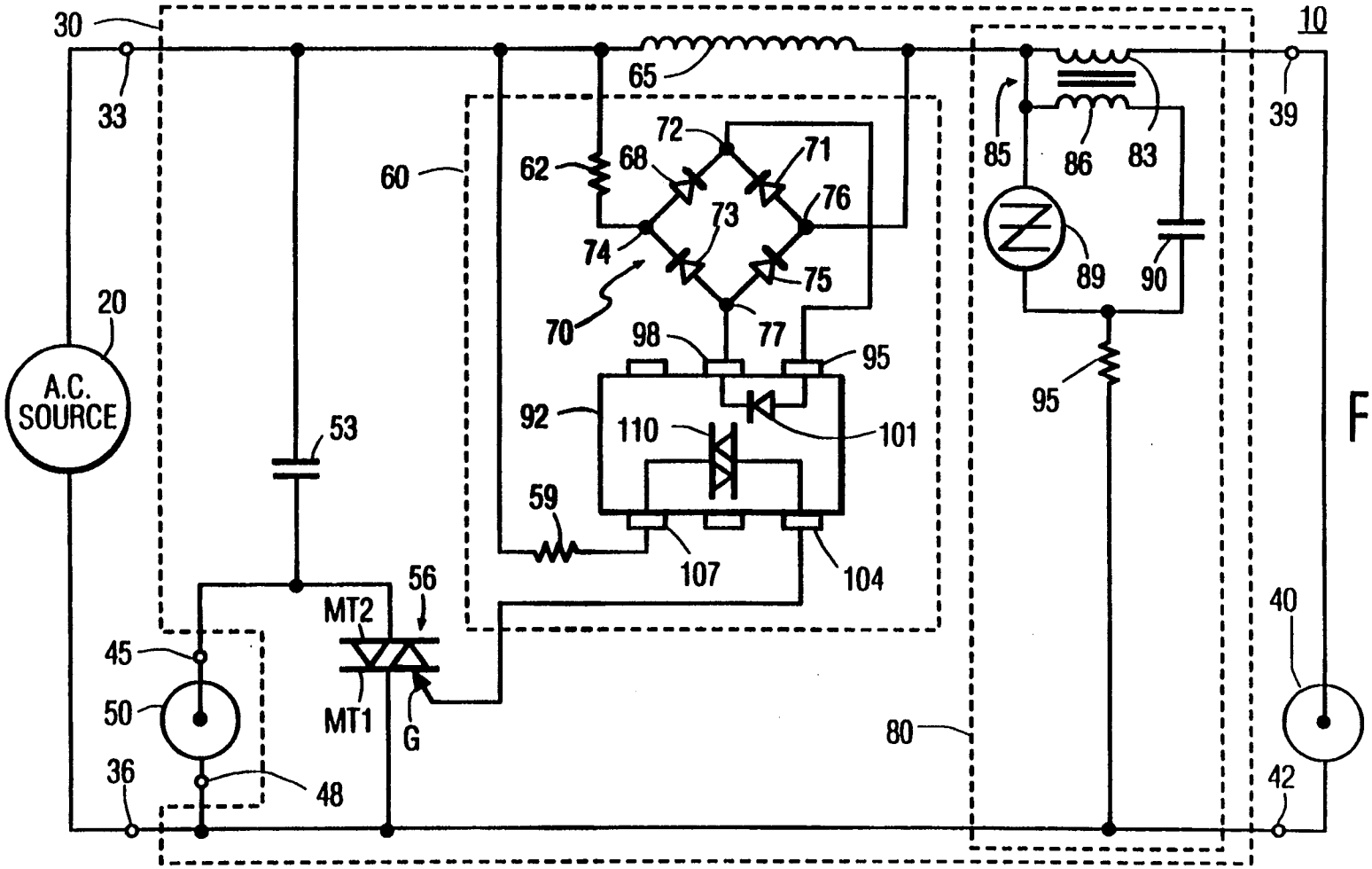
FIG. 1 is a lighting system in accordance with a first embodiment of the invention.

As shown in FIG. 1, a lighting system 10 includes an A.C. source 20 connected to a pair of input terminals 33 and 36 of a ballast 30, an HID lamp 40 and an auxiliary lamp 50. Ballast 30 includes a first pair of output terminals 39 and 42 to which HID lamp 40 is connected. Auxiliary lamp 50, which can include, but is not limited to an incandescent type, is connected to a second pair of output terminals 45 and 48 of ballast 30.

Ballast 30 also includes a power factor correction capacitor 53 connected at one end to input terminal 33 and at its other end to output terminal 45. A first main terminal (MT1) of a triac 56 is connected to the junction between input terminal 36 and output terminal 48. A second main terminal (MT2) of the triac 56 is connected to the junction between the other end of capacitor 53 and output terminal 45. Triac 56, or other suitable switching device, is therefore connected in parallel with auxiliary lamp 50.

Connected to the junction between input terminal 33 and capacitor 53 is one end of a resistor 59, one end of a resistor 62 and one end of a reactor ballast 65. Ballast 30 also includes a diode bridge 70 having four diodes 68, 71, 73 and 75. The cathodes of diodes 68 and 71 are connected together at a junction 72. The anodes of diodes 73 and 75 are connected together at a junction 77. The anode of diode 68, cathode of diode 73 and other end of resistor 62 are connected together at a junction 74. The cathode of diode 75, anode of diode 71 and other end of reactor ballast 65 are connected together at a junction 76. Resistor 62 and diode bridge 70 serve as a rectifier device connected in parallel with reactor ballast 65.

An opto-coupler 92 includes a pair of input terminals 95 and 98 connected to junctions 72 and 77 of diode bridge 70, respectively. An internal photodiode 101 of opto-coupler 92 is connected between input terminals 95 and 98 of opto-coupler 92. Opto-coupler 92 also includes a pair of output terminals 104 and 107 which are connected to a gate G of triac 56 and the other end of a resistor 59, respectively. An internal phototriac 110 of opto-coupler 92 is connected between output terminals 104 and 107.

Resistors 59 and 62, diode bridge 70 and opto-coupler 92 in combination serve as a switching control unit 60 for producing a switching (i.e. gate) signal supplied to gate G of triac 56. As will be discussed below, the switching signal represents/indicates the flow of current through ballast reactor 65 and therefore reflects the condition of operation (e.g. level of illumination) of HID lamp 40.

Connected to the junction between ballast reactor 65 and junction 76 is one end of a secondary winding 83 and one end of a primary winding 86 of an in-line pulse transformer 85 and one end of a SIDAC 89. The other end of primary winding 86 is connected to capacitor 90. The other end of secondary winding 83 serves as output terminal 39 for ballast 30. The other ends of SIDAC 89 and capacitor 90 and one end of a resistor 95 are connected together. The other end of resistor 95 is connected to the junction between main terminal MT1 of triac 56, output terminal 48, input terminal 36 and output terminal 42. Transformer 85, SIDAC 89, capacitor 90 and resistor 95 serve in combination as an ignitor 80.

Lighting system 10 operates as follows. Power is supplied from A.C. source 20 to input terminals 33 and 36 of ballast 30. In accordance with this first embodiment of the invention, the voltage produced by A.C. source 20 is insufficient to ignite/start lamp 40, the latter of which requires a supplemental starting pulse. This pulse is provided by in-line pulse transformer 85 of ignitor 80. More particularly, capacitor 90, based on the RC time constant of capacitor 90 and resistor 95, charges to the breakover voltage of SIDAC 89 at which time SIDAC 89 switches from its previous OFF state to its ON state. A rapid flow of current passes through primary winding 86 resulting in a voltage pulse produced across secondary winding 83. This voltage pulse is sufficient to ignite lamp 40. For example, when lamp 40 is of a metal halide type, nominally rated at 400 watts, 135 volts, SIDAC 89 has a breakover voltage of about 240 volts and transformer 85 has a turns ratio of primary winding 86 to secondary winding 83 of 1:10, a voltage pulse of about 1800 volts is produced across secondary winding 83 once capacitor 90 charges to the SIDAC breakover voltage of about 240 volts. This voltage pulse is sufficient to ignite lamp 40.

Prior to and until lamp 40 reaches a predetermined level of illumination, auxiliary lamp 50 is lit (i.e. triac 56 is in its open state). Preferably, lamp 50 is nominally rated at about 120 volts and when lit is serially connected to capacitor 53 (i.e. triac 56 being in its OFF state). Capacitor 53 serves to limit the flow of current through lamp 50 and produces a voltage drop so as to reduce the level of voltage applied to lamp 50 to approximately its rated value.

When HID lamp 40 is initially lit (i.e. reaches at least a predetermined level of illumination), switching control unit 60 senses an abrupt change in current flow through ballast reactor 65 (e.g. corresponding from about 0 volts to about 215 volts across reactor 65). Current flows through resistor 62, diode bridge 70 and photodiode 101 thereby illuminating the latter. The light radiating from photodiode 101 actuates (i.e. closes) phototriac 110 of opto-coupler 92. Since phototriac 110 is connected between output terminals 104 and 107 of opto-coupler 92, when triac 110 closes, current flows through resistor 59 and phototriac 110 into gate G of triac 56 as a switching (i.e. gating) signal. The switching signal closes (i.e. turns ON) triac 56 thereby short circuiting and effectively turning OFF auxiliary lamp 50. Power factor correction capacitor 53 now conducts a relatively large flow of current thereby improving the power factor of ballast 30.

Whenever HID lamp 40 is turned OFF through, for example, a momentary power interruption, control unit 60 will discontinue producing a switching signal. Accordingly, triac 56 will revert to its open/OFF state whereby auxiliary lamp 50 is once again lit. The impedances of capacitor 53 and lamp 50 are chosen such that whenever triac 56 is turned OFF sufficient current will flow through lamp 50 to light the latter. In accordance with the invention, the power factor correction scheme when not being used to offset the inductive component of current flowing through lamp 40 (i.e. when triac 56 is turned OFF) results in less current being drawn from source 20 than may be required by a conventional ballast employing a power factor correction scheme. Consequently, as compared to such conventional ballasts, a greater number of ballasts in accordance with the invention can be connected to a branch utility power line.

As can now be readily appreciated, switching control unit 60 controls when power factor correction is applied to ballast 30 and when auxiliary lamp 50 is turned ON and OFF. As can also be readily appreciated, other types of ballast configurations including a high-reactance type autotransformer ballast can be used in lieu of ballast reactor 65.

In accordance with this first preferred embodiment of the invention, A.C. source 20 produces an A.C. voltage of about 277 volts. Capacitor 53 is nominally rated at about 20 microfarads. Auxiliary lamp 50 is nominally rated at about 250 watts, 120 volts and is of the quartz incandescent type. Resistors 59, 62 and 95 are nominally rated at 40,000 ohms, 2 watts; 60,000 ohms, 2 watts and 20,000 ohms, 5 watts, respectively. Each of the diodes of diode bridge 70 is nominally rated at 240 volts lamp. Opto-coupler 92 is available from Toshiba America Inc. of Irvine, Calif. as Part No. TLP3052. Transformer 85 is a pulse transformer having a turns ratio of 1:10. Triac 56 is nominally rated at 4 amp, 800 volts and is available from Teccor Inc. of Hurd, Tex. as Part No. L8004. SIDAC 89 is also available from Teccor Inc. and has a nominally rated breakover voltage of about 240 volts. Capacitor 90 is nominally rated at about 0.15 microfarads. Lamp 40 can be a high intensity discharge type, such as but not limited to, a 400 watt, 135 volt metal halide type.

Figure 2:
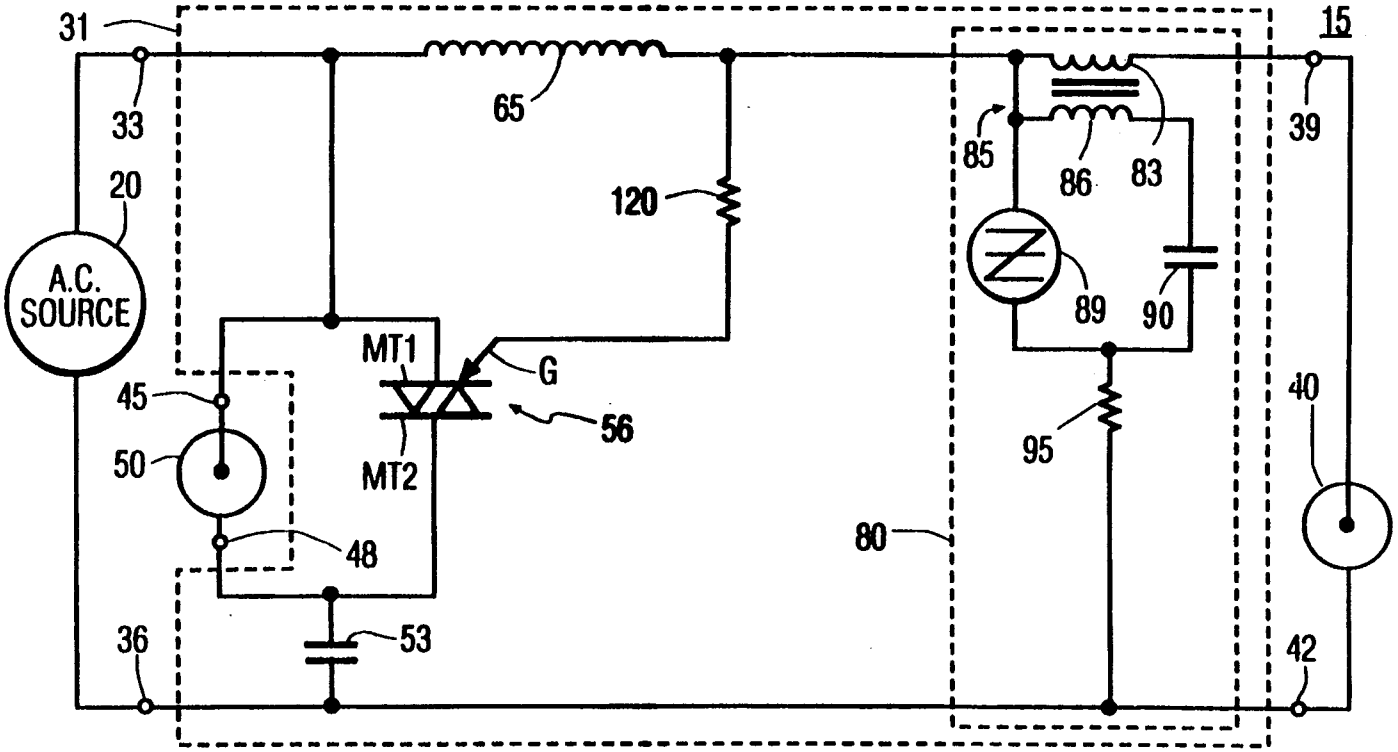
FIG. 2 is a lighting system in accordance with a second embodiment of the invention.

As shown in FIG. 2, a lighting system 15, in accordance with a second embodiment of the invention, includes a ballast 31 having a resistor 120. Ballast 31 of lighting system 15 is substantially the same as ballast 30 of lighting system 10 except that resistor 120 is substituted for control unit 60, respectively, and capacitor 53 is now positioned between input 36 and the parallel combination of lamp 50 and triac 56. More particularly, the junction between MT1 of triac 56 and output terminal 45 is connected to the junction between input terminal 33 and reactor ballast 65. Capacitor 53 is connected between input 36 and the junction between MT2 of triac 56 and output terminal 48. All other elements of lighting system 15 are similar in construction and operation to the elements shown in lighting system 10, have been identified by like reference numerals and will not be further addressed herein.

The switching (i.e. gate) signal supplied to gate G of triac 56 of lighting system 15 is provided by resistor 120. Resistor 120 is connected at one end between the junction of reactor ballast 65 and secondary winding 83 and at its other end to the gate G of triac 56. Current flowing through resistor 120, serving as the switching signal, represents/indicates the flow of current through reactor ballast 65. Similar to lighting system 10, lighting system 15 generates a pulse through ignitor 80 to ignite lamp 40. The value of capacitance of capacitor 90 of ignitor 80 in systems 10 and 15 is chosen based on the R.C. time constant of capacitor 90 and resistor 95 so as to reach the breakover rating of SIDAC 89 in a relatively short period of time. Whenever lamp 40 is lit (i.e. at a predetermined level of illumination), auxiliary lamp 50 is turned OFF. Conversely, whenever lamp 40 is not at a predetermined level of illumination, lamp 50 is turned ON. When lamp 40 reaches a predetermined level of illumination, lamp 50 is effectively turned OFF by short circuiting of same through switching of triac 56 to its closed state. The capacitive component of current drawn from A.C. source 20 now substantially offsets the inductive component of current flowing through lamp 40.

Figure 3:
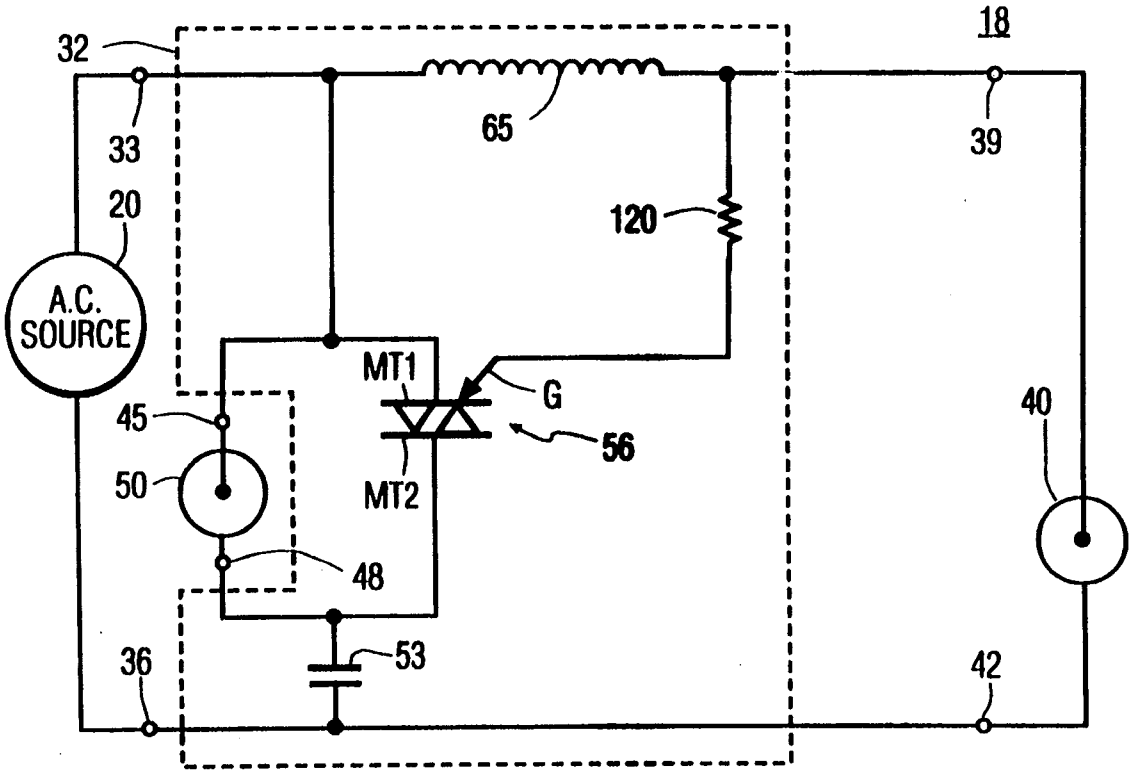
FIG. 3 is a lighting system in accordance with a third embodiment of the invention.

As shown in FIG. 3, a lighting system 18, in accordance with a third embodiment of the invention, includes a ballast 32. Ballast 32 does not include an ignitor 80. Otherwise, ballast 32 is substantially the same as ballast 31. Unlike systems 10 and 15, system 18 does not require ignitor 80 inasmuch as lamp 40 requires a much lower starting voltage which can be supplied from A.C. source 20. For example, a 175 watt mercury type HID lamp can be started from a 277 volt source serving as A.C. source 20. Operation of system 18 is otherwise similar to the operation of system 15 wherein those elements of system 18 similar in construction and operation to those elements of system 15 have been identified by like reference numerals.

As can now be readily appreciated, the present invention provides an improved ballast scheme in which an auxiliary light source (i.e. lamp 50) is turned ON whenever the primary/main light source (i.e. lamp 40) has not reached a predetermined level of illumination. When this predetermined level of illumination is reached, triac 56 short circuits auxiliary lamp 50 whereby lamp 50 is effectively turned OFF. At the same time (i.e. when lamp 50 is short circuited), the power factor of power drawn by ballasts 30, 31 and 32 is increased by substantially balancing the capacitive and inductive components of current drawn from source 20. Control unit 60 of system 10 and resistor 120 of systems 15 and 18 therefore sense the flow of current through ballast reactor 65 for controlling the ballast power factor and the operating state of auxiliary lamp 50.

It will thus be seen that the objects set forth above, and those made apparent from the preceding description, are efficiently obtained and since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A ballast for lighting at least a first lamp and a second lamp, comprising:

current control means responsive to the flow of current therethrough for controlling current flowing through said first lamp;

switching control means for producing a switching signal representing the flow of current through said current control means;

switching means responsive to said switching signal for substantially short circuiting said second lamp, and power factor correction means coupled to said switching means and to said second lamp so as to supply current to said second lamp in the absence of said switching signal whereby said second lamp is lit, and wherein the power factor correction means improves the ballast power factor during the time said second lamp is substantially short circuited by the switching means.

2. The ballast of claim 1, wherein said switching control means includes rectifier means connected in parallel with said current control means.

3. The ballast of claim 2, wherein said switching means includes a triac having a gate and wherein said switching control means further includes an opto-coupler connected to said gate for supplying said switching signal to said switching means.

4. The ballast of claim 1, wherein said switching control means includes a resistor coupled to a control electrode of said switching means and to a junction between said current control means and said first lamp.

5. A ballast for lighting at least a first lamp and a second lamp, comprising:

current control means responsive to the flow of current therethrough for controlling current flowing through said first lamp;

switching control means for producing a switching signal representing the flow of current through said current control means;

switching means responsive to said switching signal for substantially short circuiting said second lamp, and wherein said switching control means includes an opto-coupler for supplying said switching signal to said switching means.

6. The ballast of claim 5, wherein said first lamp comprises a high intensity Gistbarge type.

7. The ballast of claim 5, further including power factor correction means for improving the power factor of said ballast during the time said second lamp is short circuited.

8. The ballast of claim 7, wherein said switching means and second lamp are connected in parallel to form a parallel connection, said parallel connection being serially connected to said power factor correction means to provide a current path in shunt with said current control means and said first lamp.

9. The ballast of claim 6, wherein said second lamp is of the incandescent type and wherein said current control means includes inductance means such that the current control means exhibits inductive characteristics.

10. A ballast for lighting at least a first lame and a second lamp, comprising:

current control means responsive to the flow of current therethrough for controlling current flowing through said first lamp;

switching control means for producing a switching signal representing the flow of current through said current control means;

switching means responsive to said switching signal for substantially short circuiting said second lamp, and wherein said switching control means includes rectifier means connected in parallel with said current control means.

11. The ballast of claim 10, wherein said rectifier means includes a diode bridge and a resistor.

12. A ballast for lighting at least a first lamp and a second lamp, comprising:

current control means responsive to the flow of current therethrough for controlling current flowing through said first lamp;

switching control means for producing a switching signal representing the flow of current through said current control means;

switching means responsive to said switching signal for substantially short circuiting said second lamp, and power factor correction means for improving the power factor of power drawn by said ballast during the time said second lamp is short circuited.

13. The ballast of claim 12, wherein said switching means and second lamp are connected in parallel to form a parallel connection, said parallel connection being serially connected to said power factor correction means.

14. A ballast for lighting at least a first lamp and a second lamp, comprising:

current control means responsive to the flow of current therethrough for controlling current flowing through said first lamp;

switching control means for producing a switching signal representing the flow of current through said current control means;

switching means responsive to said switching signal for substantially short circuiting said second lamp, wherein said switching means comprises a triac having a gate and wherein said switching control means includes a resistor connected to said gate for supplying said switching signal to said switching means, and power factor correction means for improving the power factor of said ballast during the time said second lamp is short circuited.

15. The ballast of claim 14, wherein said switching means and second lamp are connected in parallel to form a parallel connection, said parallel connection being serially connected with said power factor correction means to input terminals of the ballast.

16. A ballast for lighting at least a first lamp and a second lamp, comprising:

current control means responsive to the flow of current therethrough for controlling current flowing through said first lamp;

switching control means for producing a switching signal representing the flow of current through said current control means;

switching means responsive to said switching signal for substantially short circuiting said second lamp, and wherein said switching control means includes a resistor coupled to said switching means and to a junction between said current control means and said first lamp.

17. A ballast for lighting at least a first lamp and a second lamp, comprising:

current control means responsive to the flow of current therethrough for controlling current flowing through said first lamp;

switching control means for producing a switching signal representing the flow of current through said current control means;

switching means responsive to said switching signal for substantially short circuiting said second lamp, and wherein said first lamp is a high intensity discharge type, said second lamp is of the incandescent type and said current control means includes an inductive element.

18. A method of lighting at least a first discharge lamp and a second lamp, comprising the steps of:

drawing power from a power source in supplying current to a ballast;

ballasting said first lamp in response to the flow of current through said ballast;

producing a control signal representing the flow of current through said ballast;

substantially short circuiting a second lamp in response to said control signal; and increasing the power factor of power drawn from said power source while said second lamp is short circuited.

19. Apparatus for energizing a discharge lamp and an auxiliary lamp, comprising:

first and second input terminals for connection to a source of supply voltage for the apparatus, a first pair of output terminals for connection to said discharge lamp, current control means coupled between one of said input terminals and one of said output terminals for limiting current flow through a conductive discharge lamp when connected to said output terminals, a second pair of output terminals for connection to said auxiliary lamp, and switching means coupled to said second pair of output terminals, and responsive to a control signal from said current control means which is indicative of the level of current flow through said current control means, so as to inhibit current flow through a connected auxiliary lamp at a first given level of current flow through said current control means thereby to prevent operation of the auxiliary lamp, and for allowing a sufficient current flow through a connected auxiliary lamp to operate said auxiliary lamp at a second given level of said current flow through the current control means.

20. The apparatus of claim 19 further comprising:

power factor correction means coupled to at least one input terminal, to said switching means and to at least one of said second pair of output terminals and operative to improve the power factor of power drawn by said apparatus from the input terminals during the time when the switching means prevents operation of said auxiliary lamp.

21. The apparatus of claim 20 wherein said power factor correction means is coupled to said at least one of said second pair of output terminals so as to limit current flow through a connected auxiliary lamp during a time when the switching means allows the auxiliary lamp to operate.

22. The apparatus as claimed in claim 19 wherein said switching means comprises a single controlled switching device coupled to the second pair of output terminals to form a parallel connection with a connected auxiliary lamp thereby to substantially short-circuit the connected auxiliary lamp when said switching device is triggered on by the signal from the current control means and which is produced at said first given level of current flow, and a power factor capacitor coupled in series circuit with said parallel connection to said input terminals thereby to improve the power factor of power drawn by said apparatus from the input terminals during the time when said auxiliary lamp is inoperative and being further operative so as to limit current flow through a connected auxiliary lamp during a time when the auxiliary lamp is in operation.

23. The apparatus as claimed in claim 22 wherein said current control means comprises a ballast inductor and said control signal is operative to cut-off the single switching device at said second given level of current flow through the current control means thereby to allow said current flow through a connected auxiliary lamp.

24. The apparatus of claim 19 wherein said current control means comprises a current limit ballast impedance connected in series circuit with a connected discharge lamp across the input terminals, wherein said switching means comprises a single controlled switching device coupled to the second pair of output terminals to form a parallel connection with a connected auxiliary lamp, a power factor correction device coupled in series circuit with said parallel connection to said input terminals, wherein said single controlled switching device is triggered on and off by said control signal at said first and second given levels of current flow, respectively, through the ballast impedance, thereby to substantially short-circuit a connected auxiliary lamp and to allow said sufficient current flow through the auxiliary lamp, respectively, and wherein said auxiliary lamp comprises an incandescent lamp.

25. The apparatus of claim 24 wherein the ballast impedance and the power factor correction device comprise an inductor and a capacitor, respectively, said capacitor producing power factor correction of input power and a current limit for auxiliary lamp current flow when said single controlled switching device is triggered on and off, respectively.

26. The apparatus of claim 19 wherein, said switching means comprises a single controlled switching device coupled to the second pair of output terminals to form a parallel connection with a connected auxiliary lamp, power factor correction means coupled to at least one input terminal and to said parallel connection to form a series circuit therewith, and wherein first and second given levels of current flow through the current control means correspond to a connected discharge lamp being on and off, respectively.

27. The ballast of claim 12 wherein the switching means is coupled to the power factor correction means and to the second lamp in a manner whereby, during the time said second lamp is substantially short-circuited, said first lamp is on and the power factor correction means is coupled to a source of power for the ballast via the switching means, and during a time when said first lamp is off, the switching means removes said short circuit so that the second lamp will be energized by said power source.

28. The ballast of claim 12 wherein the first lamp is a discharge lamp and the switching means is coupled to the power factor correction means and to the second lamp such that the power factor correction means is coupled to a source of power for the ballast via the switching means during the time said second lamp is substantially short circuited, and wherein during a time when said first lamp is off, the switching means removes said short circuit so that the second lamp will be energized by said power source via the power factor correction means which furthermore limits the voltage applied to the second lamp.

* * * * *